US007165826B2

(12) United States Patent
Sugaya et al.

(10) Patent No.: US 7,165,826 B2
(45) Date of Patent: Jan. 23, 2007

(54) IMAGE FORMING APPARATUS

(75) Inventors: Takumi Sugaya, Tokyo (JP); Fujio Kosaka, Hino (JP); Katsunori Kumai, Hino (JP); Toshihiro Kitahara, Tachikawa (JP); Hiroshi Hashi, Tokyo (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 10/853,726

(22) Filed: May 24, 2004

(65) Prior Publication Data

US 2004/0246322 A1 Dec. 9, 2004

(51) Int. Cl.
*B41J 2/165* (2006.01)

(52) U.S. Cl. ..... 347/32; 347/23; 347/29; 347/30; 347/33

(58) Field of Classification Search ..... 347/8, 347/37, 104, 23, 29–35; 400/56, 59
See application file for complete search history.

(56) References Cited

U.S. PATENT DOCUMENTS 5,534,897 A * 7/1996 Anderson et al. ..... 347/32
6,578,945 B1 * 6/2003 Hashi et al. ..... 347/22

FOREIGN PATENT DOCUMENTS

| | | | |
|---|---|---|---|
| JP | 2534690 | B2 | 6/1996 |
| JP | 9-057988 | A | 3/1997 |
| JP | 09-300658 | | 11/1997 |
| JP | 2000-62151 | A | 2/2000 |
| JP | 2000-263802 | A | 9/2000 |
| JP | 2001-322296 | A | 11/2001 |

* cited by examiner

*Primary Examiner*—Shih-Wen Hsieh
(74) *Attorney, Agent, or Firm*—Frishauf, Holtz, Goodman & Chick, P.C.

(57) ABSTRACT

In discharge recovery processing, a continuous sheet 23 is moved from a facing position facing a head portion 21 to a first position (in the down direction in the drawing) as an evacuating position in the discharge recovery processing, thereafter, a discharge recovery processing unit 22 in the standby mode at a second position (in the up direction in the drawing) different from the facing position is moved to the facing position, and the discharge recovery processing is performed. In the discharge recovery processing, the head unit 21 is not moved and therefore the preferable positional reproducibility is obtained after ending the discharge recovery processing.

9 Claims, 6 Drawing Sheets

IMAGE FORMING APPARATUS

TECHNICAL FIELD

The present invention relates to an image forming apparatus which forms a desired image by discharging droplets to a recording medium from droplet discharge means having a droplet discharge port and which has a discharge recovery processing unit that performs the recovery processing of discharge capability of the discharge port.

BACKGROUND ART

Recently, a so-called head scanning ink-jet printer has been remarkably developed and used to print an image by reciprocatively scanning a printer head having a plurality of nozzles over a recording medium and selectively discharging ink from the nozzles. The head scanning ink-jet printer is widespread for commercial use as well as for consumer use.

In the head scanning ink-jet printer, a short head has hundreds of nozzles which can discharge a small amount of ink droplets. One short head is attached to a carriage for each color, and a high-quality image is formed by two-dimensional relative scanning of the carriage and the recording medium. However, the above-mentioned head scanning ink-jet printer has a problem that the printing time is longer as the image quality is higher.

FIG. 9 shows a schematic diagram showing the head scanning ink-jet printer. In the printing operation, short heads K (black), C (cyan), M (magenta), and Y (yellow) discharge ink by reciprocative scanning in the width direction of a recording medium 1. Further, the recording medium 1 is conveyed in the length direction synchronously with the scanning, so as to print the image on a printing surface of the recording medium 1 as desired.

Further, FIG. 10 shows a schematic diagram showing an ink-jet printer having long heads (full-line heads) K, C, M, and Y extended with the length corresponding to the width of a printing area of the recording medium 1. The ink-jet printer shown in FIG. 10 is a so-called full-line one-path ink-jet printer with the printable image quality that is not better than that of the above-mentioned head scanning ink-jet printer. However, the ink-jet printer shown in FIG. 10 is operated at high speed because the image is printed by conveying only the recording medium 1 only in the length direction with the long heads (full-line heads) K, C, M, and Y extended with the length corresponding to the width of the printing area of the recording medium 1.

Therefore, the ink-jet printer shown in FIG. 10 is widely used for commercial purposes which do not require the high image quality of the head scanning ink-jet printer. In this case, a continuous sheet (also referred to as roll paper or Web medium) is frequently selected as the recording medium 1 in order to effectively utilize the high speed.

In the printing operation, the long heads K, C, M, and Y having at least the width of the printing area of the recording medium 1 are aligned in the conveying direction of the recording medium 1. The image is printed by selectively discharging ink from the full-line heads K, C, M, and Y in accordance with the conveyance of the recording medium 1.

Herein, as the number of nozzles increases, it is difficult to manufacture the full-line heads K, C, M, and Y in a state for accurately holding the discharge property of the nozzles and the linearity of nozzle alignment. Therefore, as the full-line heads K, C, M, and Y are longer, the costs are increased.

According to one suggested technology, one full-line head unit is formed by continuously aligning, in the width direction of the recording medium 1, a plurality of relatively inexpensive print heads with the length which is stably manufactured.

FIG. 11 shows a schematic diagram showing an ink-jet printer using the full-line head unit. The ink-jet printer shown in FIG. 11 is a full-line one-path ink-jet printer having the alignment of the number of full-line heads corresponding to the number of using colors, and comprises a head unit UK having a plurality of heads K to cover the width of the printing area of the recording medium 1. Further, the ink-jet printer shown in FIG. 11 comprises head units UC, UM, and UY with the similar alignment, which are arranged in the conveying direction of the recording medium 1. The ink-jet printer shown in FIG. 11 prints an image on the recording medium 1 by selectively discharging ink from the head units UK, UC, UM, and UY in accordance with the conveyance of the recording medium 1.

In this case, referring to FIG. 11, individual short heads K, C, M, and Y forming the head units UK, UC, UM, and UY are diagonally aligned and, thus, the continuousness is held in the nozzle pitch in the width direction of the recording medium 1 at the junction between the short heads K (C, M, and Y).

In addition to the alignment of the plurality of short heads K (C, M, and Y) forming the one full-line head unit UK (UC, UM, and UY) shown in FIG. 11, the short heads K (C, M, and Y) are arranged in a lattice. Alternatively, the nozzles at the end portions of the same-color adjacent short heads K (C, M, and Y) are overlapped at the interval corresponding to several to dozens of nozzles in the width direction of the recording medium 1, and data printed at the overlapped portion is subjected to image processing. Thus, the conjunction between the short heads K (C, M, and Y) does not become prominent.

Meanwhile, the ink-jet printer head generally needs to properly perform the processing for recovery from the discharge capability of the nozzle during the use of the ink-jet printer head.

Typically, the discharge recovery processing is as follows.

(1) Sucking processing for removing and preventing the clog of the nozzle by sucking the ink from the nozzle (2) Wiping processing for removing adherent ink droplets due to the smear on a nozzle surface or sucking processing and for forming the meniscus of the nozzle (3) Spitting processing for forcedly discharging the ink to a dedicated ink tray Some of the above-mentioned processing is not necessary, while, other processing may be necessary, depending on the ink-jet printer head. In any case, the ink-jet printer requires a function of some types of the discharge recovery processing for the printer head.

Of course, the printer head faces the position for discharging the ink droplets to the recording medium 1 during the printing operation. However, in the discharge recovery processing, the printer head needs to be moved in the direction of a discharge recovery processing unit 2 arranged to the position outside the printing area of the recording medium 1 and the printer head further needs to face the discharge recovery processing unit 2.

FIG. 12 is a schematic diagram showing a facing relationship between the recording medium 1 and the heads K, C, M, and Y in the printing operation of the ink-jet printer in a direction shown by an arrow XII shown in FIGS. 10 and 11 and showing a state in which the recording medium 1 faces the heads K, C, M, and Y.

Further, FIG. 13 is a schematic diagram showing a facing relationship between the discharge recovery processing unit 2 and the heads K, C, M, and Y in the discharge recovery processing and showing a state in which the heads K, C, M, and Y face the discharge recovery processing unit 2.

FIGS. 12 and 13 are the schematic diagrams showing the case of using the long full-line heads K, C, M, and Y shown in FIG. 10. However, the full-line heads UK, UC, UM, and UY, which are formed by combining the plurality of short heads K, C, M, and Y shown in FIG. 11, have the same principle as that of the long full-line heads K, C, M, and Y shown in FIGS. 12 and 13, and the alignments thereof and the arrangement of the corresponding discharge recovery processing unit 2 are different from those shown in FIGS. 12 and 13.

Therefore, hereinbelow, one rectangular full-line head is used for the purpose of a brief description. However, the full-line head is not limited to the single head and includes a full-line head unit comprising a plurality of short heads. Since well-known technologies can be applied to the structure and arrangement of the head and the mechanism and processing of the discharge recovery processing unit 2, the discharge recovery processing unit is a single rectangular one.

In a general facing operation of the discharge recovery processing unit 2 and the heads K, C, M, and Y in the head scanning printer, a discharge recovery mechanism is arranged out of the printing area, then, the heads K, C, M, and Y are moved to the position of the discharge recovery mechanism by using scanning mechanisms of the heads K, C, M, and Y, and the recovery processing is performed.

Further, Japanese Unexamined Patent Application Publication No. 9-57988 discloses a technology for the discharge recovery processing by moving a suction cap to a space ensured by evacuating the head in the up-direction from the printing position by a motor. This technology can be applied to a full-line printer.

Furthermore, Japanese Patent No. 2534690 discloses a method for evacuating a platen in the discharge recovery processing in an ink-jet printer using a sheet.

However, in the case of using the long head unit formed by combining one or a plurality of heads and the full-line one-path ink-jet printer using the continuous sheet, there are the following problems in the facing structure of the heads and the discharge recovery processing unit by moving the heads according to the conventional art.

(1) Misalignment of Attached Head

In many cases, the head scanning printer for consumer is formed by accurately integrating the heads corresponding to the number of used colors. Further, according to already-suggested technologies, the misalignment of the heads is suppressed by scanning the heads (by multi-paths) to the same pixel plural times.

On the other hand, in the case of the printing operation by the one path using the long head, the heads are not integrally formed and the correction processing by the multi-paths is not executed. Therefore, this requires the high accuracy (e.g., the distance between the heads and the position and rotation of nozzles in the width direction of the recording medium in the heads) for relative alignment in color heads to the recording medium.

Further, the one-path ink-jet printer is used for the commercial purpose in many cases and therefore, it is not preferable to perform registration operation frequently. The attachment accuracy needs to be kept for a long time.

The above-mentioned problems become serious, in particular, when a plurality of heads form one full-line head unit.

However, in the full-line one-path ink-jet printers, like the head scanning ink-jet printer or as disclosed in Japanese Unexamined Patent Application Publication No. 9-57988, the head portion is iteratively evacuated and returned for the discharge recovery processing and then there is a problem that the accuracy for positioning the heads is varied from the initial state thereof.

This problem necessarily causes the misalignment of registration, thus to deteriorate the printing quality.

(2) Blot on Recording Medium

In the case of using the continuous sheet, the recording medium always exists near the printing position of the head as long as the roll paper remains. Therefore, in the evacuating and returning operation of the heads for the discharge recovery processing, the positioning operation to the evacuating position and returning position causes friction or the like and the friction facilitates the fall and adhesion, on the recording medium, of ink droplets flying in all directions in the discharge recovery processing, and the recording medium might be damaged.

In order to solve the above-mentioned problem, the head portions are excessively smoothly controlled. However, in this case, the mechanism and the control operation are complicated and further cause a problem that the evacuating and returning operation requires a long time.

(3) Piping Installation of Ink Pipe

Upon using the full-line head unit comprising a plurality of heads, the piping of an ink feed pipe becomes a problem. That is, in the full-line head unit comprising a plurality of heads, the total number of heads are large. Thus, the number of ink feed pipes for feeding the ink to the heads is increased and the structure of a fluid channel of the head is complicated.

In this case, the shift of the head portion for the discharge recovery processing requires the movement of the ink feed pipe having the complicated structure of the fluid channel together with the heads. Therefore, the space for piping the ink feed pipe must be ensured and further the ink feed pipe must be set to have the optimal length. The manufacture and assembly are complicated and the manufacturing costs are increased.

(4) Avoidance of Platen on Continuous Sheet

The Japanese Patent No. 2534690 discloses the technology by which, in the printer having the recording medium as the sheet, the platen is moved in the sheet conveying direction or is opened and thus the discharge recovery processing unit faces the head portion.

However, when a driving mechanism for moving the platen is applied to the printer using the continuous sheet, the continuous sheet always exists at the position facing the head until the paper-out state of the printer. This application is impossible.

Further, the mechanism for opening the platen is applied to the one-path ink-jet printer corresponding to a plurality of colors. Then, the interval between the heads is wider depending on the evacuating space of the platen. Not only the alignment space of the heads increases but also the position of the color heads are not easily adjusted.

Furthermore, the one-path ink-jet printer has a wide area of the platen. Therefore, the interval between the sheet and the head in the printing operation does not ensure the opening operation of the platen.

Under the above-mentioned circumstances, it is an object of the present invention to provide an image forming apparatus, in which the blot on the recording medium is prevented in the discharge recovery processing of the droplet discharge means in the full-line one-path ink-jet printer, the continuous sheet as the recorded sheet is not an obstacle, the piping of the ink pipe connected to the droplet discharge means is easy, and the preferable image quality is obtained with the high positional-reproducibility of the droplet discharge means after ending the discharge recovery processing.

DISCLOSURE OF INVENTION

According to the present invention, an image forming apparatus forms a desired image by discharging droplets to a recording medium from a plurality of droplet discharge means having a droplet discharge port, and has a discharge recovery processing unit for performing the recovery processing of the discharge capability of the discharge port. The image forming apparatus comprises: recording medium moving means which can move the recording medium to a facing position facing the droplet discharge means and a first position different from the facing position; and discharge recovery processing unit moving means which can move the discharge recovery processing unit to the facing position facing the droplet discharge means and a second position different from the facing position, wherein the recording medium moving means moves the recording medium from the facing position to the first position, thereafter, the discharge recovery processing unit moving means moves the discharge recovery processing unit from the second position to the facing position, and thus the droplet discharge means faces the discharge recovery processing unit.

BRIEF DESCRIPTION OF THE DRAWINGS

FIG. 1 is a block diagram showing the structure of a full-line one-path ink-jet printer;

FIG. 2 is a schematic diagram for explaining a printing state of a printer engine portion;

FIG. 3 is a side view of an arrow III shown in FIG. 2;

FIG. 4 is a schematic diagram for explaining a state of discharge recovery processing of the printer engine portion;

FIG. 5 is a side view of an arrow V shown in FIG. 4;

BEST MODE FOR CARRYING OUT THE INVENTION

Embodiments of the present invention will be described in detail with reference to the drawings. Hereinbelow, a recording medium is typically expressed as "continuous sheet" or "sheet", however, the recording medium of the present invention is not limited to the sheet and can be applied to various materials such as a resin sheet member, depending on using ink.

First Embodiment

FIGS. 1 to 5 show the first embodiment of the present invention.

Figure 1:
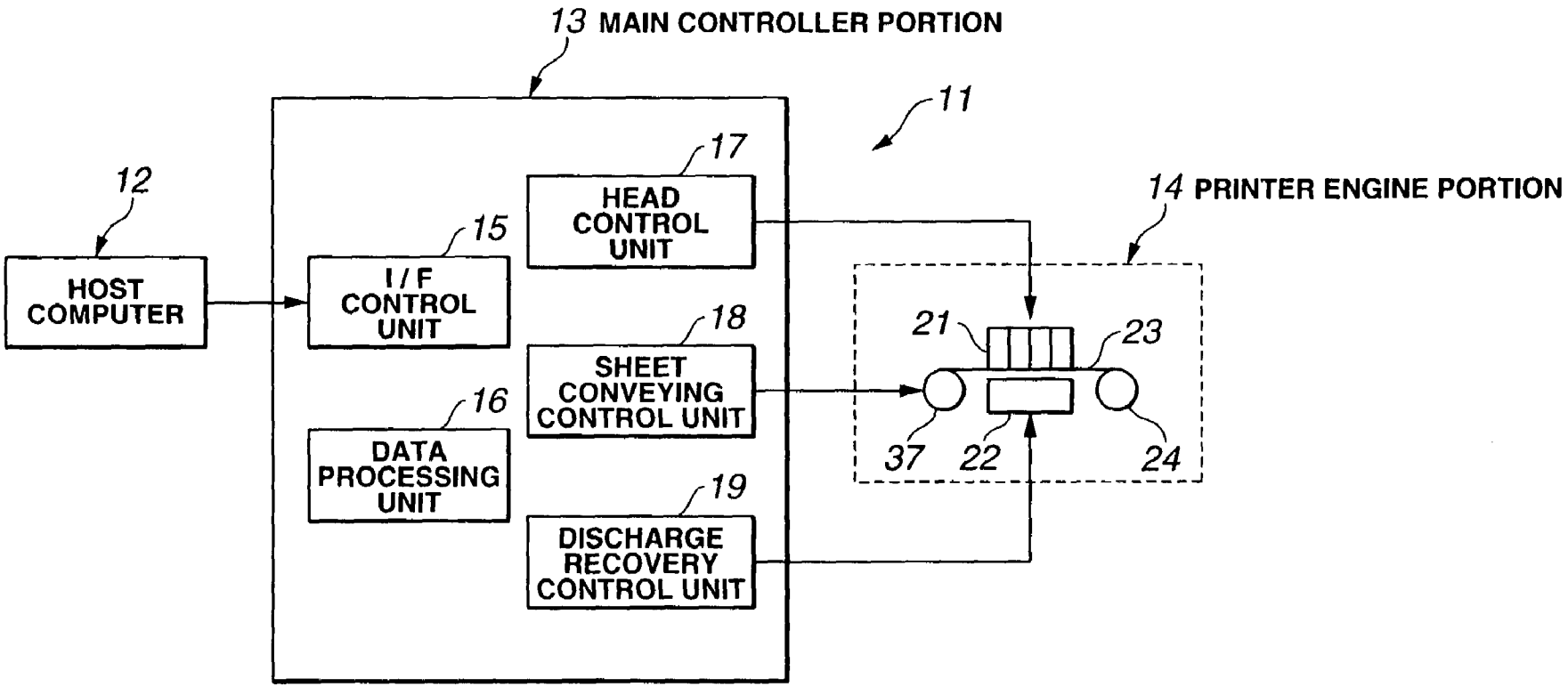
FIG. 1 to FIG. 5 show a first embodiment of the present invention.

Referring to FIG. 1, in a full-line one-path ink-jet printer 11 according to the first embodiment, various control units control a printer engine portion 14 based on image data or command transmitted from a host computer 12 under the control of a main controller unit 13. Further, the full-line one-path ink-jet printer 11 has a function for printing an image and for the recovery of discharge by the operation including sheet conveyance and ink discharge and the like.

Hereinbelow, the operation will briefly be described.

In the printing, first, the image data and command are inputted to the main controller unit 13 via an I/F (interface) control unit 15 from the host computer 12.

The main controller unit 13 interprets the received command, and integrally controls a data processing unit 16 and control units 17 to 19, which will be described later.

The data processing unit 16 performs, based on an instruction from the main controller unit 13, processing for variously correcting the image or converting the image data into discharge data matching heads, and stores the processed data into an internal buffer memory (not shown).

The head control unit 17 reads the discharge data from the buffer memory (not shown) included in the data processing unit 16 based on the instruction from the main controller unit 13, transmits the read data to the heads at a predetermined timing, and discharges the ink by driving the heads.

The sheet conveying control unit 18 controls the conveyance of a predetermined number of continuous sheets 23 at a predetermined speed at a predetermined timing based on the instruction from the main controller unit 13.

Incidentally, in the discharge recovery, an instruction for recovering the discharge is inputted via the I/F control unit 15, from the host computer 12 or an operating panel (not shown) included in the printer.

The main-controller unit 13 interprets the instruction for recovering the discharge and integrally controls the control units 17 to 19 and the data processing unit 16.

If spitting processing is necessary, the main controller unit 13 transmits or generates the discharge data for the spitting processing to the data processing unit 16, thereby storing the discharge data in the buffer memory in the data processing unit 16.

Similarly, if the spitting processing is necessary, the head control unit 17 reads the discharge data from the buffer memory included in the data processing unit 16 based on the instruction from the main controller unit 13, transmits the read data to the heads at a predetermined timing, and discharges the ink by driving the heads.

The sheet conveyance control unit 18 controls a predetermined number of continuous sheets 23 based on the instruction from the main controller unit 13 at a predetermined timing at a predetermined speed so as to perform a predetermined operation for evacuating the recording medium.

Further, a head unit 21 is arranged to the printer engine portion 14 as droplet discharge means, and the discharge recovery control unit 19 performs predetermined discharge recovery processing of the head unit 21 at a predetermined timing based on the instruction from the main controller unit 13.

Figure 2:
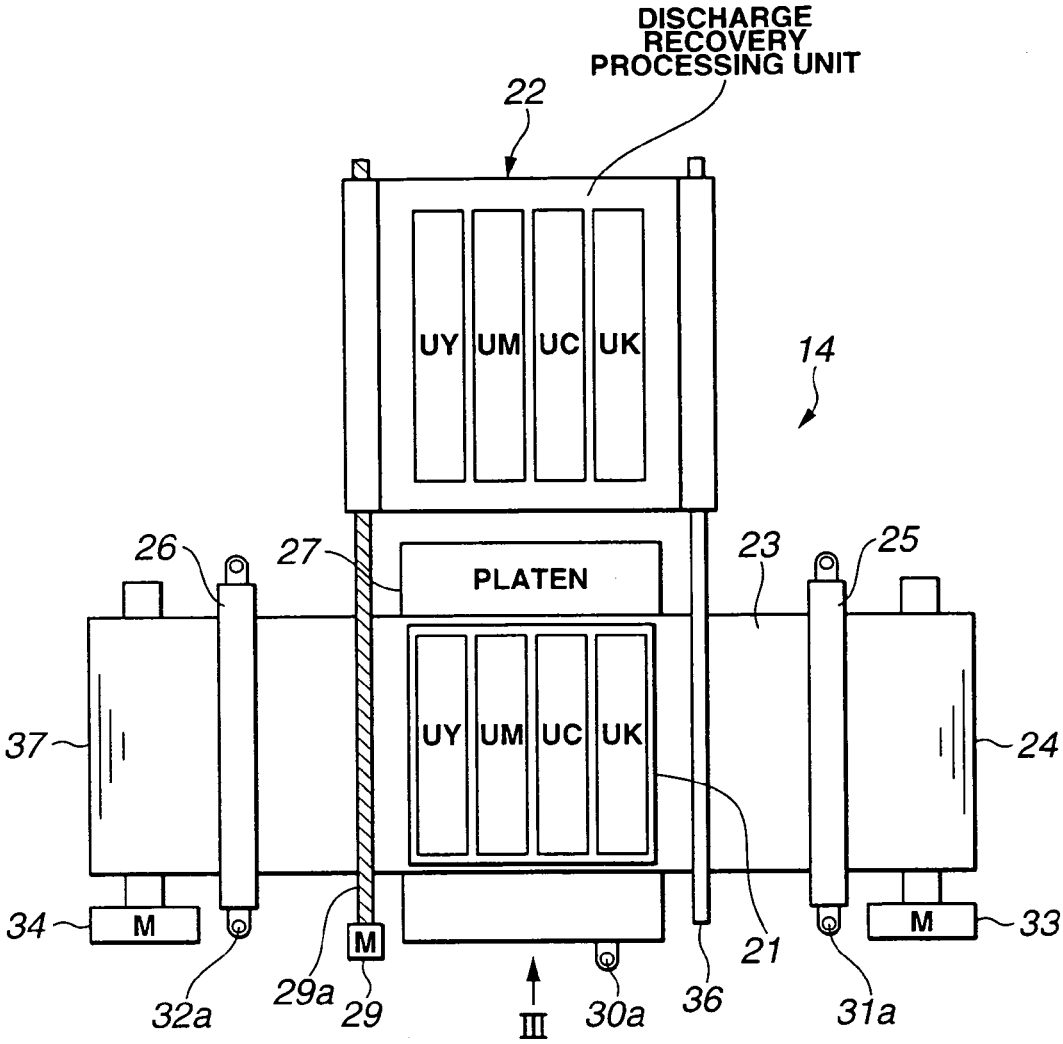
Figure 3:
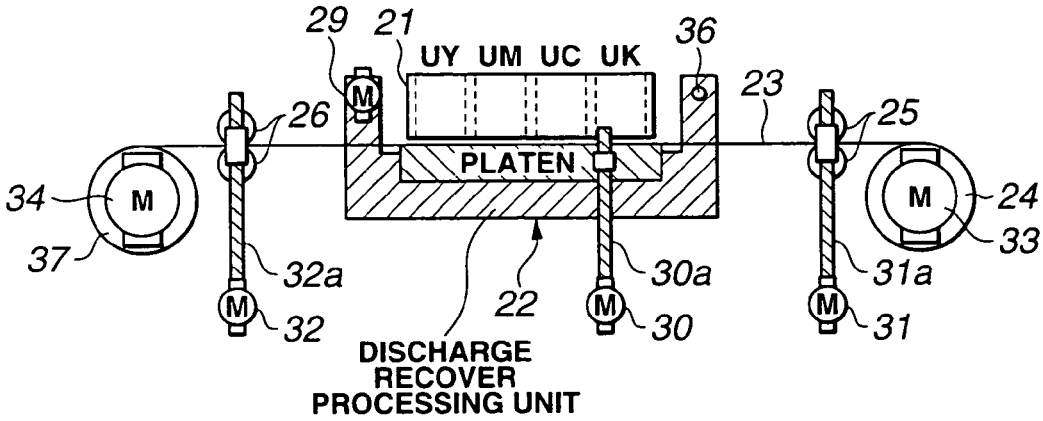

Next, a description is given of the facing operation of the head unit 21 and a discharge recovery processing unit 22 in the printer engine portion 14 with reference to FIGS. 2 and 3. It is assumed that the following operation is executed under the integral control of the main controller unit 13 unless otherwise noted.

In the head unit 21, full-line head units UY, UM, UC, and UK for each color for covering the width of the continuous sheet 23 comprise one or a plurality of heads, respectively. The full-line head units UY, UM, UC, and UK are arranged in parallel along the sheet conveying direction from the upstream to the downstream. A plurality of discharge ports (not shown) for dropping ink droplets are aligned at a predetermined interval on the bottom of the full-line head units UY, UM, UC, and UK shown in FIG. 3.

The continuous sheet 23 rolled to a delivery roller 24 faces the head unit 21 at a predetermined interval by a pair of an upstream guide roller 25 and a downstream guide roller 26 and a platen 27.

Meanwhile, the discharge recovery processing unit 22 is continuously arranged to a moving step motor 29 to be movable via a lead screw 29*a* as a moving shaft, and is positioned in the evacuating state, namely, at the second position (evacuated position) which does not prevent the printing of the head unit 21.

Referring to FIGS. 2 and 3, the discharge recovery processing unit 22 is evacuated to the depth side in the head unit 21 and the platen 27. Referring to FIG. 3, the discharge recovery processing unit 22 and the platen 27 are hatched for the purpose of clearly showing the evacuating state of the discharge recovery processing unit 22.

Figure 4:
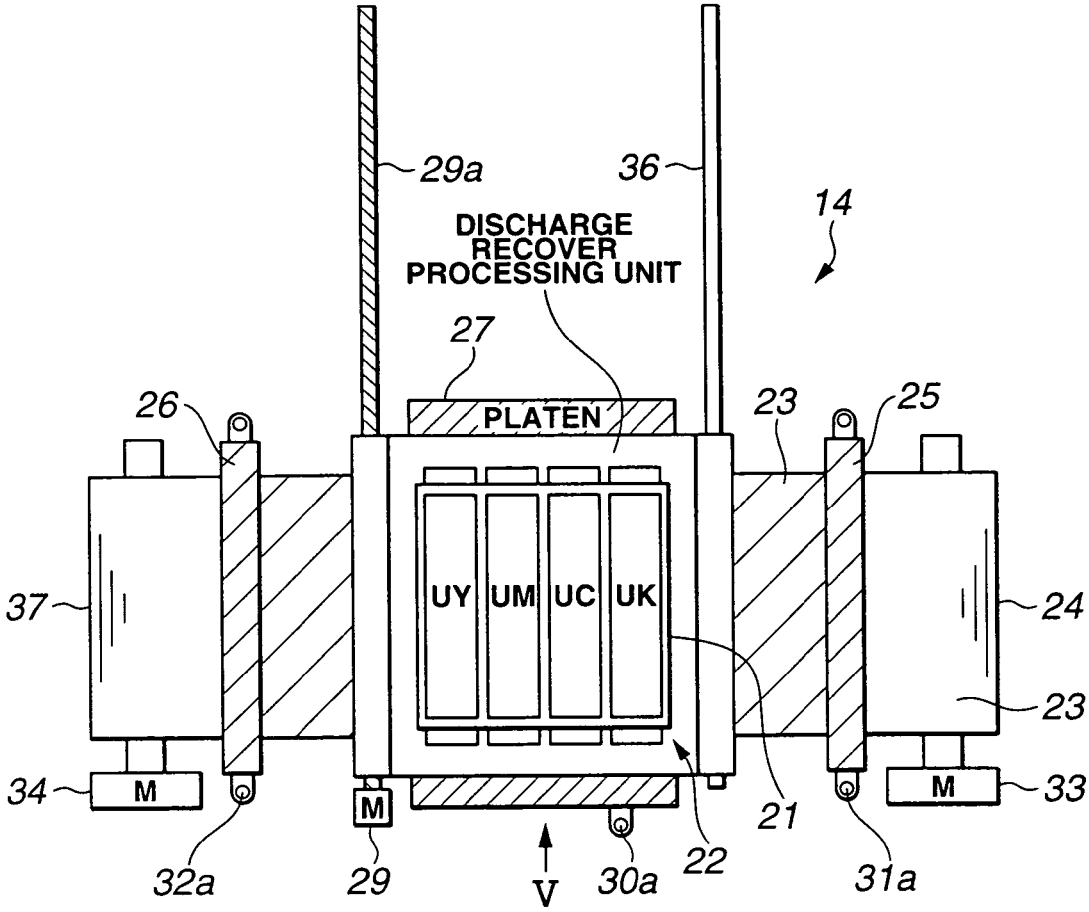
Figure 5:
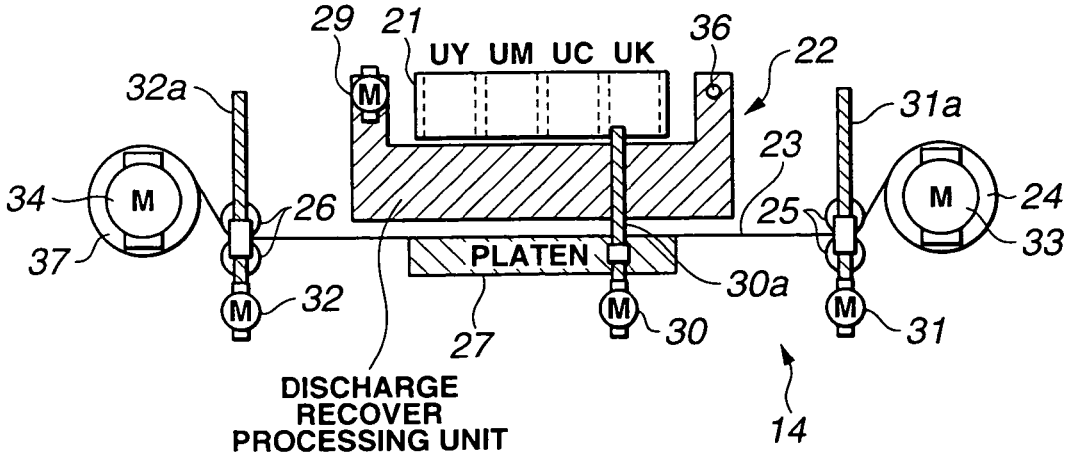

Next, a description is given of the facing operation of the head unit 21 and the discharge recovery processing unit 22 in the printer engine portion 14 in the state of the discharge recovery processing with reference to FIGS. 4 and 5.

The following operating routine is executed for the sequence for shifting the printing state shown in FIGS. 2 and 3 to the state of discharge recovery shown in FIGS. 4 and 5.

(1) A platen moving step motor 30 functions as platen moving means which moves up and down the platen 27 via a lead screw 30*a*. First, the platen moving step motor 30 is rotated by a predetermined number of steps to drop and evacuate the platen 27 to the first position that does not prevent the movement of the discharge recovery processing unit 22. Referring to FIG. 4, the platen 27 is hatched for clear indication of the evacuating state of the platen 27.

(2) Moving step motors 31 and 32 function as guide roller moving means which is continuously set to the upstream guide roller 25 and the downstream guide roller 26 via lead screws 31*a* and 32*a*. The moving step motors 31 and 32 are synchronously rotated by a predetermined number of steps to simultaneously move down the upstream guide roller 25 and the downstream guide roller 26. Then, the continuous sheet 23 sandwiched by the upstream guide roller 25 and downstream guide roller 26, facing the head unit 21, is moved down to the first position that does not prevent the movement of the discharge recovery processing unit 22.

A delivery motor 33 having an encoder (not shown) functions as delivery roller moving means and a wind-up motor 34 having an encoder (not shown) functions as wind-up roller moving means. The delivery motor 33 and the wind-up motor 34 are simultaneously rotated in the normal and reverse directions, thereby rotating the delivery roller 24 and a wind-up roller 37 which are continuously set to the delivery motor 33 and the wind-up motor 34 to roll out the continuous sheet 23 corresponding to the stroke amount necessary for the evacuation. Referring to FIG. 4, the continuous sheet 23, the upstream guide roller 25, and the downstream guide roller 26 are hatched for the purpose of clearly indicating the evacuating state of the continuous sheet 23.

The lead screw 29*a* supports both sides of the discharge recovery processing unit 22 and is continuously set to the moving step motor 29. A guide rail 36 functions as a moving shaft. The lead screw 29*a* and the guide rail 36 are located at the position that does not overlap with the space through which the continuous sheet 23, the pair of upstream guide roller 25 and the downstream guide roller 26 as the moving means of the continuous sheet 23, and the platen 27 pass during the movement from the printing position to the position in the discharge recovery. That is, the continuous sheet 23, the upstream guide roller 25, the downstream guide roller 26, and the platen 27 are positioned rather near the head unit 21 side than on the side of the printing surface of the continuous sheet 23 in the printing operation as shown in FIGS. 2 to 5. Thus, the evacuation of the units is not prevented.

(3) After that, the moving step motor 29 is rotated by a predetermined number of steps so that the discharge recovery processing unit 22 is horizontally moved and is positioned to the facing position facing the head unit 21 from the second position (evacuating position in the printing operation).

It is assumed that a cover or a casing without space is arranged to the surface on the side facing the continuous sheet 23 in the discharge recovery processing unit 22. Because it is possible to prevent the ink or the like from adhering to the continuous sheet 23 from the discharge recovery processing unit 22 and to further prevent the continuous sheet 23 from being contaminated under the affection of friction upon positioning the discharge recovery processing unit 22 at the position for the discharge recovery.

According to the above-described sequence (1) to (3), a series of operations is executed. That is, the platen 27 and the continuous sheet 23 are moved to the evacuating position upon the discharge recovery from the position facing the head unit 21 and, then, the discharge recovery processing unit 22 is moved to the position facing the head unit 21 from the evacuating position in the printing operation. Thereafter, the discharge recovery processing starts.

The predetermined discharge recovery processing ends. Then, the printer returns to the printing state shown in FIGS. 2 and 3 from the discharge recovery state shown in FIGS. 4 and 5.

In this case, the inverse processing is performed in accordance with the sequence inverse to the above-described operating sequence. That is, first, the discharge recovery processing unit 22 is moved to the second position (position for evacuating in the printing operation) and, in accordance with the movement of the upstream guide roller 25 and the downstream guide roller 26, the wind-up roller 37 and the delivery roller 24 wind up again the continuous sheet 23 corresponding to the stroke amount which is extra rolled out. Further, the printing surface of the continuous sheet 23 is moved to the facing position facing the head unit 21, and the platen 27 is furthermore moved to the facing position and is abutted against the back surface of the continuous sheet 23.

In the above description, the power source of the moving means uses the moving step motors 29 to 32 and the lead screws 29*a* to 32*a*. However, the driving source is not limited to those and various mechanisms can be used. For example, a linear motor can directly move the moving means or the moving means can be operated by combining a motor, a cam, and an arm.

Further, upon moving the continuous sheet 23 to the evacuating position, the necessary stroke is assured by rolling out the continuous sheet 23 from both the wind-up roller 37 and the delivery roller 24. In addition, the continuous sheet 23 may be rolled out from only the delivery roller 24.

The printed continuous sheet 23 rolled by the wind-up roller 37 is not in contact with the downstream guide roller 26 by rolling out the continuous sheet 23 from only the delivery roller 24. Therefore, the printed continuous sheet 23 is not contaminated. Moreover, the countermeasure against the blot on the printed continuous sheet 23 is not necessary in the discharge recovery processing, and the structure is simplified.

Second Embodiment

Figure 6:
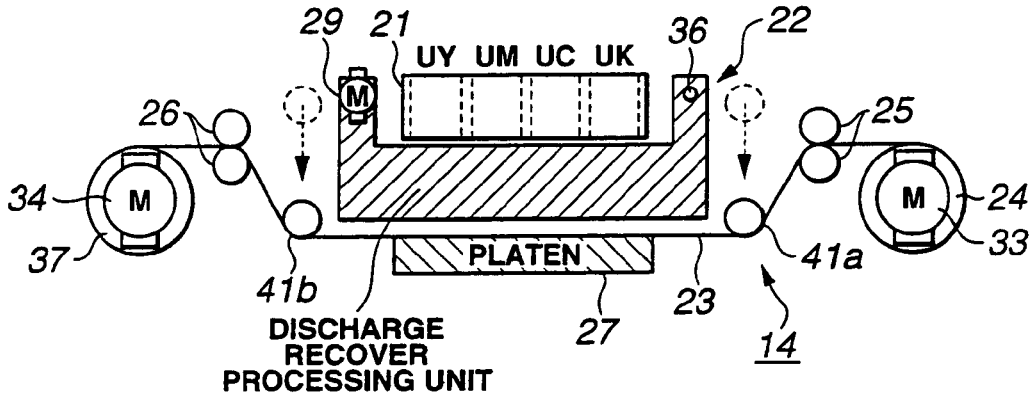
FIG. 6 is a schematic diagram for explaining a state of discharge recovery processing of a printer engine portion according to a second embodiment of the present invention.

FIG. 6 schematically shows a side view for explaining the state of the discharge recovery processing of a printer engine portion 14 according to the second embodiment of the present invention.

According to the first embodiment, upon evacuating the continuous sheet 23, the upstream guide roller 25 and the downstream guide roller 26 are moved to ensure the stroke of the continuous sheet 23. The upstream guide roller 25 and the downstream guide roller 26 have an important function for determining the distance between the head unit 21 and the printing surface of the continuous sheet 23.

Unpreferably, the movement of the upstream guide roller 25 and the downstream guide roller 26 easily causes a problem in the positional reproducibility upon the return to the printing state.

Then, according to the second embodiment, except for the upstream guide roller 25 and the downstream guide roller 26, a pair of evacuating rollers 41*a* and 41*b* are additionally arranged to the head unit 21 side of the upstream guide roller 25 and the downstream guide roller 26. The evacuating rollers 41*a* and 41*b* function as rollers for evacuating the recording medium, which evacuate the continuous sheet 23.

According to the second embodiment, the upstream guide roller 25 and the downstream guide roller 26 do not need to be moved up and down. Therefore, the rising and falling mechanism of the upstream guide roller 25 and the downstream guide roller 26 is disused. Referring to FIG. 6, a driving mechanism of the evacuating rollers 41*a* and 41*b* is omitted for the purpose of a brief description. Specifically, the evacuating rollers 41*a* and 41*b* are individually and continuously set to the moving step motors as roller moving means for evacuating the recording medium via lead screws, and are moved up and down by the rotation of the moving step motors.

With the above structure, the following operating sequence is performed to shift the printer engine portion 14 from the printing state to the discharge recovery state shown in FIG. 6.

(1) The moving step motor (not shown) is rotated by a predetermined number of steps. Thus, the platen 27 is moved down and is evacuated to the first position that does not prevent the movement of the discharge recovery processing unit 22.

(2) The moving step motors (not shown) are continuously set, via the lead screws (not shown) to the evacuating roller 41*a* on the upstream side and the evacuating roller 41*b* on the downstream side which are positioned rather on the head unit 21 side than on the side of the printing surface of the continuous sheet 23 in the printing operation. The evacuating rollers 41*a* and 41*b* are moved down from the position shown by a broken line in FIG. 6 to the first position that does not prevent the movement of the discharge recovery processing unit 22 shown by a solid line in FIG. 6, by rotating the step motors by a predetermined number of steps.

Then, the evacuating rollers 41*a* and 41*b* press the continuous sheet 23, and the continuous sheet 23 facing the head unit 21 is evacuated to the first position on the down side in FIG. 6.

Simultaneously, the wind-up motor 34 and the delivery motor 33 including encoders (not shown) are rotated in the normal and reverse directions. Consequently, the continuous sheet 23 rolled to the delivery roller 24 and the wind-up roller 37 is rolled out and the stroke amount necessary for evacuation is ensured.

(3) After that, the moving step motor 29 for moving the discharge recovery processing unit 22 is rotated by a predetermined number of steps. The discharge recovery processing unit 22 is moved and is positioned to the facing position facing the head unit 21, from the second position (evacuating position in the printing operation).

According to the above-mentioned sequence (1) to (3), a series of operations is executed. That is, the platen 27 and the continuous sheet 23 are moved to the evacuating position upon the discharge recovery from the position facing the head unit 21. Thereafter, the discharge recovery processing unit 22 is moved to the position facing the head unit 21 from the evacuating position in the printing operation. Then, the discharge recovery processing starts.

The predetermined discharge recovery processing ends. Then, the printer returns from the discharge recovery state shown in FIG. 6 to the printing state.

In this case, the inverse processing is performed in accordance with the sequence inverse to the above-described operating sequence. That is, first, the discharge recovery processing unit 22 is moved to the second position (position for evacuating in the printing operation) and, in accordance with the movement of the evacuating rollers 41*a* and 41*b*, the wind-up roller 37 and the delivery roller 24 wind up again the continuous sheet 23 extra rolled-out. Further, the printing surface of the continuous sheet 23 is moved to the facing position capable of facing the head unit 21, and the platen 27 is moved to the facing position and is abutted against the back surface of the continuous sheet 23.

The evacuating rollers 41*a* and 41*b* are evacuated to the head unit 21 side, not on the side of the printing surface of the continuous sheet 23 in the printing operation. Thus, the distance between the head unit 21 and the printing surface of the continuous sheet 23 is set to the proper distance by the upstream guide roller 25 and the downstream guide roller 26. The reproducibility is preferable.

According to the second embodiment, upon evacuating the continuous sheet 23, the continuous sheet 23 corresponding to the necessary stroke is rolled out from both the wind-up roller 37 and the delivery roller 24. However, the necessary stroke may be rolled out from only the delivery roller 24.

Third Embodiment

Figure 7:
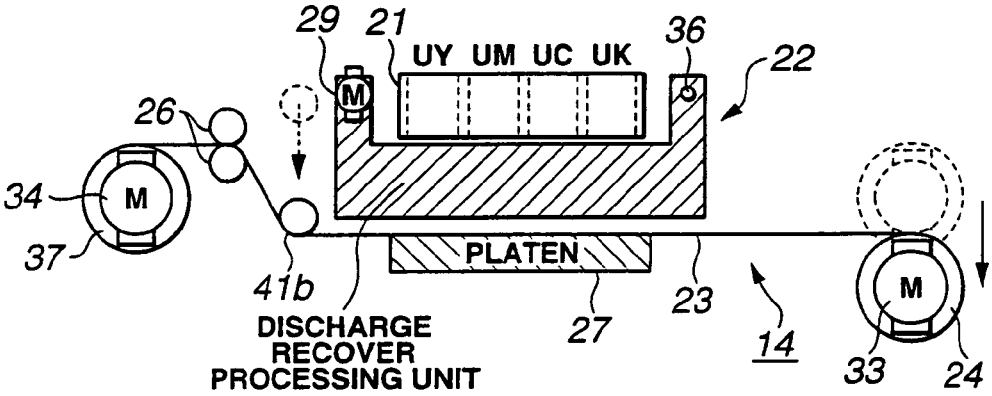
FIG. 7 is a schematic diagram for explaining a state of discharge recovery processing of a printer engine portion according to a third embodiment of the present invention.

FIG. 7 schematically shows a side view for explaining the state of the discharge recovery processing of a printer engine portion 14 according to the third embodiment of the present invention.

According to the second embodiment, the evacuating rollers 41*a* and 41*b* are arranged, sandwiching the head unit 21. Depending on the design accuracy of a mechanical system, one of the evacuating rollers 41*a* and 41*b* on the upstream and downstream sides can be used.

According to the third embodiment, the continuous sheet 23 is evacuated by moving up the evacuating roller 41*b* on the downstream side and the delivery roller 24 arranged to the opposite portion of the evacuating roller 41*b* on the downstream side, sandwiching the head unit 21. The upstream guide roller 25 and the evacuating roller 41*a* on the upstream side according to the second embodiment are disused.

That is, the following operating sequence is performed to shift the printer engine portion 14 from the printing state to the discharge recovery state shown in FIG. 7.

(1) The moving step motor (not shown) is rotated by a predetermined number of steps. Thus, the platen 27 is moved down and is evacuated to the first position that does not prevent the movement of the discharge recovery processing unit 22.

(2) The moving step motor (not shown) is rotated by a predetermined number of steps, thereby moving down the evacuating roller 41*b* on the downstream side positioned rather on the head side than the printing surface of the continuous sheet 23 to the first position that does not prevent the movement of the discharge recovery processing unit 22 from the position shown by a broken line in FIG. 7. Meanwhile, the delivery roller 24 is moved down by a delivery roller moving mechanism (not shown) synchronously with the evacuating roller 41*b* on the downstream side while the delivery roller 24 and the evacuating roller 41*b* on the downstream side have a horizontal relationship.

Then, the continuous sheet 23 is guided by both rollers 41*b* and 24 and moved down to the first position that does not prevent the movement of the discharge recovery processing unit 22, thus to form a space for setting the discharge recovery processing unit 22 between the printing surface of the continuous sheet 23 and the head unit 21.

Simultaneously, one of the wind-up motor 34 and the delivery motor 33 including the encoders (not shown) is rotated in the normal or reverse direction. Consequently, the continuous sheet 23 rolled to one of the delivery roller 24 and the wind-up roller 37 is rolled out and the stroke amount necessary for evacuation of the continuous sheet 23 is ensured.

(3) After that, the moving step motor 29 is rotated by a predetermined number of steps. The discharge recovery processing unit 22 is moved and is positioned to the facing position facing the head unit 21, from the second position (evacuating position in the printing operation).

According to the above-mentioned sequence (1) to (3), a series of operations is executed. That is, the platen 27 and the continuous sheet 23 are moved to the evacuating position upon the discharge recovery from the position facing the head unit 21. Thereafter, the discharge recovery processing unit 22 is moved to the position facing the head unit 21 from the evacuating position in the printing operation. Then, the discharge recovery processing starts.

The predetermined discharge recovery processing ends. Then, the printer returns from the discharge recovery state shown in FIG. 7 to the printing state.

In this case, the inverse processing is performed in accordance with the sequence inverse to the above-described operating sequence. That is, first, the discharge recovery processing unit 22 is moved to the second position (position for evacuating in the printing operation) and, in accordance with the movement of the evacuating roller 41*b* on the downstream side and the delivery roller 24, one of the wind-up roller 37 and the delivery roller 24 winds up again the continuous sheet 23 extra rolled-out. Further, the printing surface of the continuous sheet 23 is moved to the facing position facing the head unit 21 and the platen 27 is moved to the facing position and is abutted against the back surface of the continuous sheet 23.

According to the third embodiment, upon evacuating the continuous sheet 23, the continuous sheet 23 corresponding to the necessary stroke is rolled out from one of the wind-up roller 37 and the delivery roller 24. However, the continuous sheet 23 corresponding to the necessary stroke may be rolled out from both the delivery roller 24 and the wind-up roller 37.

Further, according to the third embodiment, the continuous sheet 23 is evacuated by moving the evacuating roller 41*b* on the downstream side and the delivery roller 24. However, the similar advantages may be obtained by arranging upstream the evacuating roller and the guide roller and moving up the evacuating roller on the upstream side and the wind-up roller 37.

Furthermore, according to the third embodiment, the evacuating roller is used. However, the guide roller 26 may have the function of the evacuating roller, similarly to the first embodiment.

Fourth Embodiment

Figure 8:
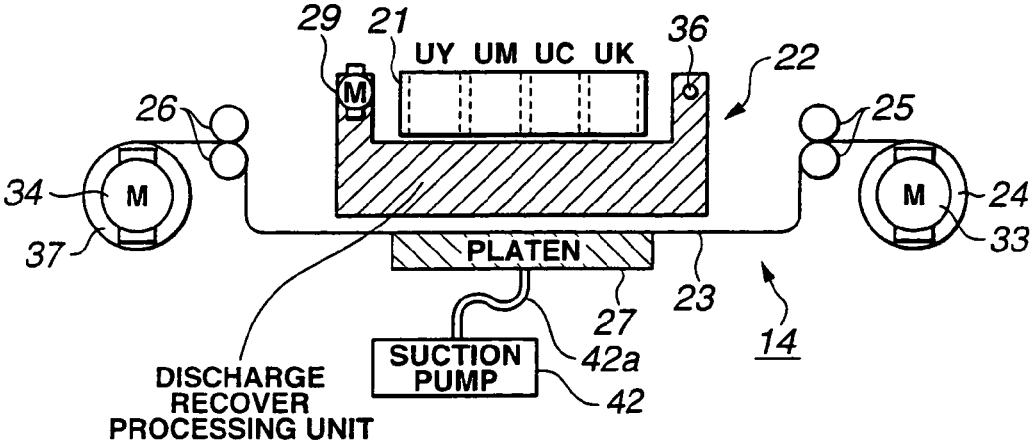
FIG. 8 is a schematic diagram for explaining a state of discharge recovery processing of a printer engine portion according to a fourth embodiment of the present invention.
Figure 9:
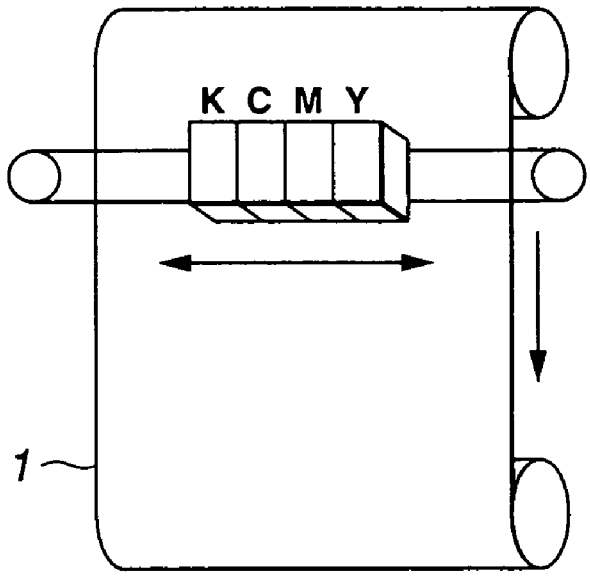
FIG. 9 is a schematic diagram showing a conventional head scanning ink-jet printer according to one conventional art.
Figure 10:
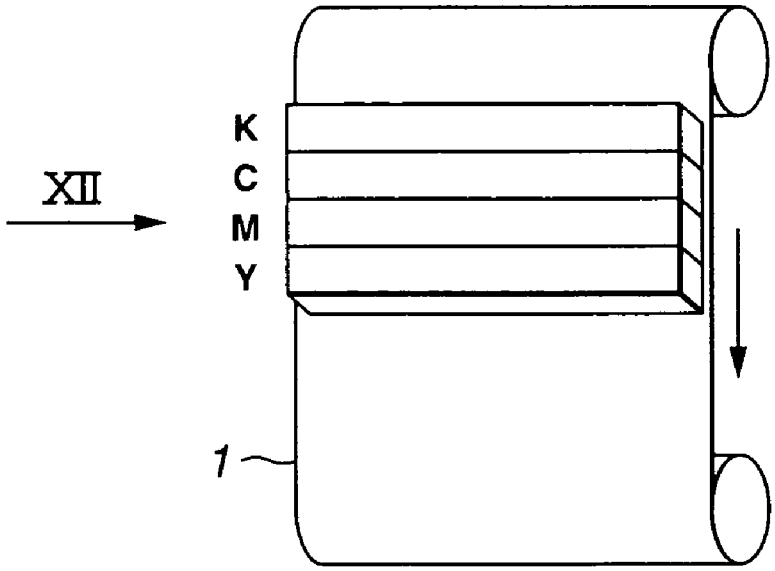
FIG. 10 is a schematic diagram showing a full-line one-path ink-jet printer according to another conventional art.
Figure 11:
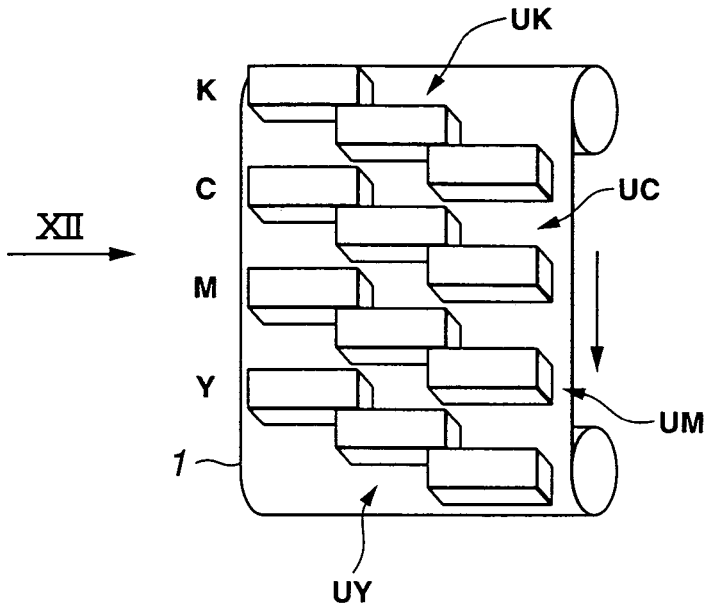
FIG. 11 is a schematic diagram showing an ink-jet printer using a full-line head unit according to the other conventional art.
Figure 12:
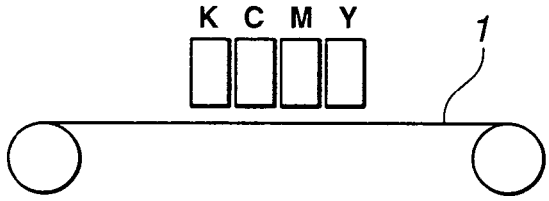
FIG. 12 is a side view of an arrow XII shown in FIGS. 10 and 11.
Figure 13:
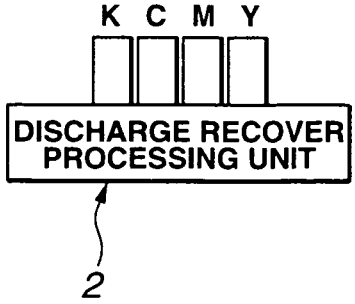
FIG. 13 is a schematic diagram showing a facing relationship between the heads and a discharge recovery processing unit according to the other conventional art.

FIG. 8 schematically shows a side view for explaining the state of the discharge recovery processing of a printer engine portion 14 according to the fourth embodiment of the present invention.

For example, an industrial wide-format printer has a function for adhering the continuous sheet 23 to the platen 27 in many cases. Referring to FIG. 8, as typical adhering means, numerous small holes are pierced through the platen 27, a suction pump 42 is connected to the platen 27 via a suction pipe 42*a*, and the suction pump 42 is operated. Thus, the inside of the small holes pierced through the platen 27 is set to have the negative pressure and the continuous sheet 23 is adhered to the surface of the platen 27. Alternatively, the continuous sheet 23 is electrostatically adhered to the platen 27.

According to the fourth embodiment, adhering means provided for the printer engine portion 14 is used. Thus, the continuous sheet 23 is evacuated only by rolling out the continuous sheet 23 and moving the platen 27 without moving the upstream guide roller 25, the downstream guide roller 26, the delivery roller 24, and the wind-up roller 37.

That is, the following operating sequence is performed to shift the printer engine portion 14 from the printing state to the discharge recovery state shown in FIG. 8.

(1) First, the moving step motor (not shown) is rotated by a predetermined number of steps. Thus, the platen 27 is moved down and is evacuated to the first position that does not prevent the movement of the discharge recovery processing unit 22. Further, the continuous sheet 23 is rolled out corresponding to the length of the stroke amount of the continuous sheet 23 necessary for evacuation by controlling the delivery roller 24 and the wind-up roller 37.

In this case, the suction force of the platen 27 is maintained in the state similar to that in the printing operation, thereby evacuating the continuous sheet 23 adhering to the platen 27.

(2) Next, the moving step motor 29 is rotated by a predetermined number of steps. Thus, the discharge recovery processing unit 22 is horizontally moved from second position (position for evacuating in the printing operation) to the facing position facing the head unit 21 and is positioned.

According to the above-mentioned sequence (1) and (2), a series of operations is executed. That is, the platen 27 and the continuous sheet 23 are moved to the evacuating position upon the discharge recovery from the position facing the head unit 21. Thereafter, the discharge recovery processing unit 22 is moved to the position facing the head unit 21 from the evacuating position in the printing operation. Then, the discharge recovery processing starts.

The predetermined discharge recovery processing ends. Then, the printer returns from the discharge recovery state shown in FIG. 8 to the printing state.

In this case, the inverse processing is performed in accordance with the sequence inverse to the above-described operating sequence. That is, the discharge recovery processing unit 22 is moved to the second position (position for evacuating in the printing operation) and, in accordance with the return movement of the platen 27, the wind-up roller 37 and the delivery roller 24 wind up again the continuous sheet 23 extra rolled-out. Further, the printing surface of the continuous sheet 23 is moved to the facing position facing the head unit 21.

According to the fourth embodiment, upon evacuating the continuous sheet 23, the continuous sheet 23 corresponding to the necessary stroke is rolled out from both the wind-up roller 37 and the delivery roller 24. However, the necessary stroke may be rolled out from only the delivery roller 24.

The present invention is not limited to the first to fourth embodiments. According to the first to fourth embodiments, the platen is evacuated and then the continuous sheet is evacuated. However, both the platen and the continuous sheet may simultaneously be evacuated. Alternatively, the same advantages are obtained by evacuating the platen and the continuous sheet with the same power source. Further, upon the return operation to the recording position, the platen and the continuous sheet may simultaneously be evacuated.

INDUSTRIAL APPLICABILITY

According to the present invention, advantageously, the blot on the recording medium is prevented in the discharge recovery processing, the continuous sheet as the recorded sheet is not an obstacle, the piping of the ink pipe connected to the droplet discharge means is easy, and the preferable image quality is obtained with the high positional-reproducibility of the droplet discharge means after ending the discharge recovery processing.

The invention claimed is:

1. An image forming apparatus for forming an image by discharging droplets to a recording medium from droplet discharge ports of a plurality of droplet discharge units, said image forming apparatus comprising:

a discharge recovery processing unit for performing recovery processing of droplets discharged from the discharge port;

a recording medium moving mechanism which moves the recording medium between a first position facing the droplet discharge units and a second position also facing the droplet discharge units, said second position being more distant from the droplet discharge units than the first position; and a discharge recovery processing unit moving mechanism which moves the discharge recovery processing unit between a first position facing the droplet discharge units and a second position different from the first position, wherein the discharge recovery processing unit moving mechanism moves the discharge recovery processing unit from the second position to the first position after the recording medium moving mechanism moves the recording medium from the first position to the second position, such that the droplet discharge units face the discharge recovery processing unit, and wherein the discharge recovery processing unit moving mechanism comprises at least one continuous moving shaft that is positioned on a same side of a printing surface of the recording medium as the droplet discharge units during printing.

2. An image forming apparatus for forming an image by discharging droplets to a recording medium from droplet discharge ports of a plurality of droplet discharge units, said image forming apparatus comprising:

a discharge recovery processing unit for performing recovery processing of droplets discharged from the discharge port;

a recording medium moving mechanism which moves the recording medium between a first position facing the droplet discharge units and a second position different from the first position; and a discharge recovery processing unit moving mechanism which moves the discharge recovery processing unit between a first position facing the droplet discharge units and a second position different from the first position, wherein the discharge recovery processing unit moving mechanism moves the discharge recovery processing unit from the second position to the first position after the recording medium moving mechanism moves the recording medium from the first position to the second position, such that the droplet discharge units face the discharge recovery processing unit, wherein the recording medium moving mechanism comprises: (i) a guide roller which sets an interval between the droplet discharge mechanism and the recording medium during printing, and (ii) a guide roller moving mechanism which moves the guide roller, wherein the discharge recovery processing unit moving mechanism moves the discharge recovery processing unit from the second position to the first position after the guide roller is moved by the guide roller moving mechanism to move the recording medium from the first position to the second position, such that the droplet discharge units face the discharge recovery processing unit, and wherein the discharge recovery processing unit moving mechanism comprises at least one continuous moving shaft that is positioned on a same side of the printing surface of the recording medium as the droplet discharge units during printing.

3. An ink jet printer for forming an image by discharging ink to a recording medium from an ink jet head having a plurality of nozzles for discharging ink, said printer comprising:

a recording medium moving mechanism which moves the recording medium and which moves a position at which the recording medium is supported between a first position at which the recording medium faces the ink jet head in a position to perform image recording on the recording medium and a second position at which the recording medium faces the ink jet head in a position where image recording on the recording medium is not possible, said second position being more distant from the ink jet head than the first position; and a discharge recovery processing unit which performs recovery processing while the ink jet head discharges ink, and which is movable between a first position facing the ink jet head at which it is possible to perform the recovery processing and a second position different from the first position at which it is not possible to perform the recovery processing;

wherein the discharge recover processing unit moves from the second position to the first position after the recording medium moving mechanism moves the position at which the recording medium is supported from the first position to the second position, so that the ink jet head opposes the discharge recovery processing unit, wherein the recording medium moving mechanism comprises:

a platen which sets a gap between the ink jet head and the recording medium during printing; and a platen moving mechanism for moving the platen; and wherein the discharge recovery processing unit moves from the second position to the first position after the platen is moved by the platen moving mechanism to move the recording medium from the first position to the second position, so that the ink jet head opposes the discharge recovery processing unit.

4. An ink jet printer according to claim 3, wherein the recording medium moving mechanism further comprises: (i) a guide roller which, with the platen, sets the gap between the ink jet head and the recording medium during printing, and (ii) a guide roller moving mechanism which moves the guide roller, and wherein the discharge recovery processing unit moves from the second position to the first position after the guide roller is moved by the guide roller moving mechanism to move the recording medium from the first position to the second position, so that the ink jet head opposes the discharge recovery processing unit.

5. An ink jet printer according to claim 4, further comprising a shaft that guides movement of the discharge recovery processing unit and is positioned on a same side of a printing surface of the recording medium as the ink jet head during printing.

6. An ink jet printer according to claim 3, wherein the recording medium moving mechanism supports the recording medium such that a direction in which the recording medium extends at the first position is parallel to a direction in which the recording medium extends at the second position.

7. An ink jet printer according to claim 3, wherein the discharge recovery processing unit is provided in a same orientation at the first position and the second position.

8. An ink jet printer according to claim 3, wherein the recording medium moving mechanism moves a web.

9. An ink jet printer according to claim 3, wherein a plane in which a surface of the platen is positioned at the first position is parallel to a plane in which the surface of the platen is positioned at the second position.

* * * * *

UNITED STATES PATENT AND TRADEMARK OFFICE

CERTIFICATE OF CORRECTION

PATENT NO. : 7,165,826 B2
APPLICATION NO. : 10/853726
DATED : January 23, 2007
INVENTOR(S) : Takumi Sugaya et al.

It is certified that error appears in the above-identified patent and that said Letters Patent is hereby corrected as shown below:

On the Title Page, column 1, insert as follows below Item (65):

--Related U.S. Application Data

(63) Continuation of application No. PCT/JP02/12507 filed on November 29, 2002.

Foreign Application Priority Data

(30) Nov. 30, 2001 (JP) .....2001-367811--

Signed and Sealed this

Twenty-sixth Day of January, 2010

David J. Kappos

David J. Kappos
*Director of the United States Patent and Trademark Office*